US009150315B2

(12) United States Patent
Vollenkemper

(10) Patent No.: US 9,150,315 B2
(45) Date of Patent: Oct. 6, 2015

(54) METHOD AND DEVICE FOR FILLING A BAG

(75) Inventor: Willi Vollenkemper, Oelde (DE)

(73) Assignee: HAVER & BOECKER OHG, Oelde (DE)

( * ) Notice: Subject to any disclaimer, the term of this patent is extended or adjusted under 35 U.S.C. 154(b) by 879 days.

(21) Appl. No.: 13/281,760

(22) Filed: Oct. 26, 2011

(65) Prior Publication Data

US 2012/0096815 A1 Apr. 26, 2012

(30) Foreign Application Priority Data

Oct. 26, 2010 (DE) ..... 10 2010 049 369

(51) Int. Cl.

| | |
|---|---|
| ***B65B 9/13*** | (2006.01) |
| ***B65B 43/46*** | (2006.01) |
| ***B65B 59/00*** | (2006.01) |
| ***B65B 1/18*** | (2006.01) |
| ***B65B 7/02*** | (2006.01) |
| ***B65B 43/26*** | (2006.01) |
| ***B65B 43/30*** | (2006.01) |

(52) U.S. Cl.

CPC ... *B65B 9/13* (2013.01); *B65B 1/18* (2013.01); *B65B 7/025* (2013.01); *B65B 43/262* (2013.01); *B65B 43/30* (2013.01); *B65B 43/465* (2013.01); *B65B 59/00* (2013.01)

(58) Field of Classification Search

CPC ..... B65B 1/18; B65B 3/17; B65B 7/025; B65B 43/465; B65B 43/30; B65B 43/262; B65B 7/06; B65B 39/08; B65B 43/26; B65B 43/34; B65B 59/00; B65B 59/02

USPC ..... 53/469, 284.7, 567, 570, 459, 384.1, 53/562, 393.6, 571

See application file for complete search history.

(56) References Cited

U.S. PATENT DOCUMENTS

| | | | | |
|---|---|---|---|---|
| 2,054,279 | A * | 9/1936 | Briggs | 53/276 |
| 2,601,480 | A * | 6/1952 | Williams | 53/370.2 |
| 3,148,489 | A * | 9/1964 | Senior et al. | 53/412 |
| 3,243,937 | A * | 4/1966 | Ragan | 53/384.1 |
| 3,812,644 | A * | 5/1974 | Kamikawa et al. | 53/459 |
| 3,855,907 | A * | 12/1974 | Johnson et al. | 493/235 |
| 3,949,536 | A * | 4/1976 | Chevalier | 53/570 |
| 4,071,999 | A * | 2/1978 | Nolet | 53/370.4 |
| 4,432,186 | A * | 2/1984 | McGregor | 53/69 |
| 5,177,939 | A * | 1/1993 | Lipes | 53/572 |
| 6,662,532 | B1 * | 12/2003 | Droog et al. | 53/459 |
| 6,976,350 | B2 * | 12/2005 | Greening et al. | 53/571 |
| 7,490,451 | B2 | 2/2009 | Matthews | |
| 7,877,966 | B2 | 2/2011 | Knoke et al. | |
| 2004/0123569 | A1 * | 7/2004 | Jacobsen et al. | 53/469 |
| 2005/0210841 | A1 * | 9/2005 | Hannen | 53/567 |
| 2007/0258665 | A1 * | 11/2007 | Greco et al. | 383/63 |
| 2007/0294982 | A1 | 12/2007 | Knoke et al. | |
| 2008/0264003 | A1 * | 10/2008 | Van Der Knijff et al. | 53/571 |
| 2009/0235616 | A1 * | 9/2009 | Combrink | 53/456 |

FOREIGN PATENT DOCUMENTS

| | | | |
|---|---|---|---|
| DE | 9301355 | U1 | 11/1993 |
| DE | 102005037916 | A1 | 5/2006 |
| GB | 937010 | A | 9/1963 |

* cited by examiner

*Primary Examiner* — Stephen F Gerrity
*Assistant Examiner* — Joy N Sanders
(74) *Attorney, Agent, or Firm* — Pearne & Gordon LLP

(57) ABSTRACT

Apparatus and method for filling bags wherein the bags are gusseted and extend from a first end to a second end. The gussets are optionally pulled outwardly out of the second bag end by means of a spreader device to provide a large filling mouth. The bag is attached to a filling spout by its opened second end where it is filled at least in part before the second end of the bag is closed by means of a closing device by way of at least one closing seam.

6 Claims, 3 Drawing Sheets

METHOD AND DEVICE FOR FILLING A BAG

FIELD OF THE INVENTION

The present invention relates to a method and a packaging machine for filling bags. The bags are either pre-fabricated and then fed to the packaging machine or else the bags are manufactured in the packaging machine itself or else in a device installed upstream of the packaging machine. For manufacturing the bags, tubular material is in particular rolled off a material roll, a specified length of tubular material is separated and provided with a bottom seam before the bag is filled through the upper filling end that has been left open. Following the filling operation the filling end is closed.

DESCRIPTION OF RELATED ART

Packaging machines where the bag is formed, filled and then sealed within the machine itself, are also known as Form Fill Seal machines (FFS machines).

These FFS machines are capable of flexible manufacturing of bags according to current conditions. Thus different sizes of packages can be manufactured and for example filled with the same filling material or else with different products.

Changes of the length of the manufactured bag allow varying the filled quantities. Thus it is for example possible to fill package sizes of 20 kg, 30 kg or 40 kg for example with cement.

Other than the bag length it is also conceivable to vary the bag width to arrive at the indicated broad range of filled quantities while the bags on the whole appear appealing.

To attain an optically appealing shape and improved stackability, bags tend to be provided with gussets and the corners to be trimmed by welding so as to obtain square-shaped bags after filling. Then the bags may be stood on their bottom walls in the shop and their side surfaces can be printed on for advertising the filled product.

The possible variance of widths of the tubular material employed is limited by the filling spout size to which the tubular material is attached for filling. Basically the largest possible cross-section of the filling spout is aimed at to ensure the fastest possible filling operation. Therefore the processed tubular material cannot be arbitrarily reduced in width if bags are intended to be filled with very large quantities.

SUMMARY OF THE INVENTION

It is therefore the object of the present invention to provide a packaging machine and a method for filling bags allowing a larger variance of the package sizes which one machine can fill up.

This object is solved by a packaging machine having the features of claim 1 and by a method having the features of claim 6. Preferred embodiments are the subjects of the subclaims.

The packaging machine according to the invention serves for filling bags which bags extend from a first end to a second end. A spreader device is provided and set up for pulling the gussets outwardly out of the second bag end. A conveying device is set up for attaching the bag to a filling spout by the opened second end. A closing device is provided for closing the second end of the bag by means of a closing seam.

The packaging machine according to the invention also offers many advantages since it allows to process bags of small widths. Since at the second end the gussets are pulled outwardly out of the bag the bag is virtually converted to a flat bag at the second end thus offering a larger filling mouth. This allows to fill smaller dimensioned bags at the filling spout of the packaging machine which is otherwise suitable for larger, gusseted packages. This results in more flexibility when using the packaging machine.

The invention allows filling bags by means of a packaging machine with the range of filled volumes being considerably extended downwardly without requiring complicated retrofitting of the packaging machine in operation. For example the filled volumes can be extended to a range of 2 to 50 liters while conventional packaging machines provide ranges between 10 and 50 liters or between 10 and 50 kg. The technical changes for conversion to a packaging machine according to the invention are relatively small.

Preferably the packaging machine is provided with at least one film reservoir and at least one bag forming device for manufacturing individual bags from gusseted tubular material. Or else it is conceivable to feed bags from a bag dispenser. The gusseted bags can be processed as needed for example for filling larger packages. For smaller package sizes and in the case of narrow films the gussets can be pulled out of the bag at one end such that the thus generated filling mouth can be attached to the packaging machine filling spout.

Particularly preferably a device for generating corner seams is provided which makes corner seams in the gusset regions in particular at the first bag end.

In any case it is optionally possible to pull the gussets out of the bag as needed. The dedicated device may be provided to be displaceable manually or automatically between a working position and an idle position. In the idle position the gussets remain in both ends of the bag such that square-shaped bags are filled. In the working position the gussets are pulled outwardly such that the head is formed as a flat bag while the bottom is shaped square.

A bag filled by means of the packaging machine according to the invention is formed of at least one bag wall extending from a first end to a second end. The bag wall is provided with gussets at the first end and formed as a gusseted bag. At the second end the bag may optionally be formed as a gusseted bag with gussets or as a flat bag without gussets.

The optional filling into bags provided entirely or partially with gussets has many advantages. A considerable advantage of the packaging machine is that at one end the bag is gusseted so as to provide good standing ability on this end while at the other end the gussets are pulled outwardly as needed so as to form a flat bag on the other end. Thus a large advertising surface is offered. When the bag is filled from the second end the entire cross-section of the bag can be used for filling. At the gusseted end only the cross-section between the inner ends of the gussets can be used for filling.

For example when the width of the gusseted tubular material is 300 mm and the gusset depth is 30 mm, then there is a clear width between the inner gusset ends of 240 mm. Consequently the maximum outer periphery of a filling spout can in this example be just under 480 mm. However, if the gussets are pulled out from the bag interior at the second end and placed flat to form a flat bag then the indicated example will show a total width of 360 mm. This means that the filling spout to which such an end can be attached, can have a maximum outer periphery of just under 720 mm. This means that, given a specific filling spout having a specific outer periphery, the invention permits filling bags having clearly larger variances in width of the gusseted tubular material without involving changing the filling spout.

This allows a considerably wider variance of filled bags. The variance of the bags filled by means of a packaging machine can for example be increased to the range from 5 kg or liters up to 50 kg or liters without requiring changes of size-related parts which results in clearly more flexibility in employing the packaging machine. The volume that can be filled into a tubular film of a predetermined width can be varied by a factor of up to 25 or more without requiring extensive retrofitting of the packaging machine. The filled volume may optionally be considerably varied from batch to batch or even from bag to bag.

At this point reference is made to the fact that the bag in the sense of the present application is understood to be an open bag or open-mouth bag. An open bag is understood to mean a bag that is filled at one of its ends over a major portion of its cross-section. After the bag has been filled through the filling end the bag mouth is closed such that the open bag can subsequently be sealed tight. The term open bag indicates the method of filling and does not refer in any way to the seal tightness of the open bag filled with product.

In all of the configurations the bag wall may be configured in multiple layers. The bag wall is designed to be circumferential.

After filling and closing the bag the first end is provided with a first closing seam and the second end, with a second closing seam.

Preferably the packaging machine makes corner seams in the bag wall at the first end. These corner seams result in a particularly appealing shape of the first bag end since it is virtually shaped as a square. This allows the bag to readily stand up on its first end.

Preferably the bag wall is substantially configured in two layers at the second end over the entire width. This in particular applies to bags produced from a tubular material that is manufactured directly cylindrically. Or else it is possible to firstly manufacture the tubular material from flat sheeting which is folded over and connected with one another at the side edges for manufacturing the tubular material. Such tubular material provides for an overlap of the side edges in one area. In this way the tubular material is triple-layered in one area in its width while otherwise being double-layered.

Particularly preferably the bag width of a bag manufactured by means of the packaging machine is optionally wider at the second end than at the first end.

In particular can the first end of the finished bag be square-shaped and the second end wedge-shaped in a front view wherein the bag widens toward the second end.

Due to its wedge shape the second end offers a particularly large advertising surface which may be provided with product information or graphs or the like. It is for example possible to place the bag on its square-shaped first end in a shop rack such that the second, wedge-shaped end extends upwardly, offering a fine presentation surface.

Basically the gussets might be folded back inwardly after filling. This is, however, technically difficult against the product level.

Preferably the bag wall of a bag filled by means of the packaging machine comprises closing seams at the first and the second end each wherein in particular at least one of the closing seams is configured as a weld seam. In all of the embodiments it is preferred for the filling mouth to be provided at the second end.

In all of the cases a first width at the first end is about half the periphery of the bag wall minus a double gusset depth. A second width at the second end corresponds to half the periphery of the bag wall, thus being clearly larger. The difference may be up to 5%, 10% each or even more.

To facilitate handling the bag may be provided with a cut handle which is preferably manufactured after filling near the second end and where the two layers of the bag wall are circumferentially welded to one another to ensure tight sealing. Or else the cut handle may be attached externally of the product area.

The method according to the invention provides for a gusseted bag to optionally pull out the gussets at one end only. Thereafter the bag is filled and closed. The invention allows in an advantageous way to fill bags with product. By way of pulling the gussets outwardly out of the bag interior at one end a flat bag portion is formed while the gussets remain folded in at the other end.

Preferably the bag is formed at a bag forming device from a gusseted tubular material. It is conceivable for the tubular material to consist of a plastic film or of multiple, interconnected plastic films. Or else it is also conceivable to process tubular material from paper or a paper composite.

A portion forming the bag wall is separated from the tubular material and a closing seam is made at a first end and the bag is filled from the second end which is subsequently closed by a closing seam.

The closing seam advantageously extends through the folded-in gussets at the first end. The closing seam preferably extends at the second end over the folded-open gussets. To this end the gusset regions are pulled outwardly at the second end prior to filling and closing.

In all of the configurations it is preferred for the second end to be attached to a filling spout for filling. Advantageous configurations provide for corner seams to be formed at one end only.

In all of the cases it is possible to die-cut a cut handle or multiple cut handles out of the bag wall wherein the layers of the tubular material are welded to one another circumferentially around the cut handle to allow a tight sealing of the cut handle.

BRIEF DESCRIPTION OF THE DRAWINGS

Further advantages and features of the present invention follow from the embodiment which will be explained below with reference to the enclosed figures.

The figures show in.

DETAILED DESCRIPTION OF PREFERRED EMBODIMENTS OF THE INVENTION

Figure 1:
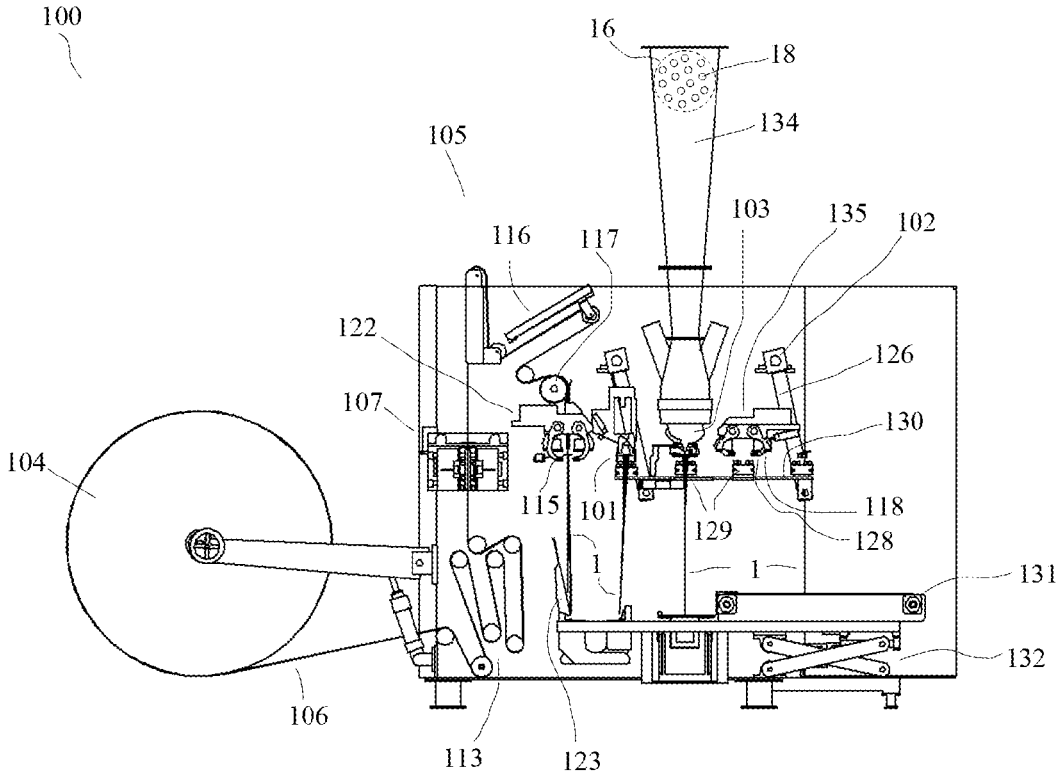
FIG. 1 a schematic side view of a packaging machine according to the invention.
Figure 2:
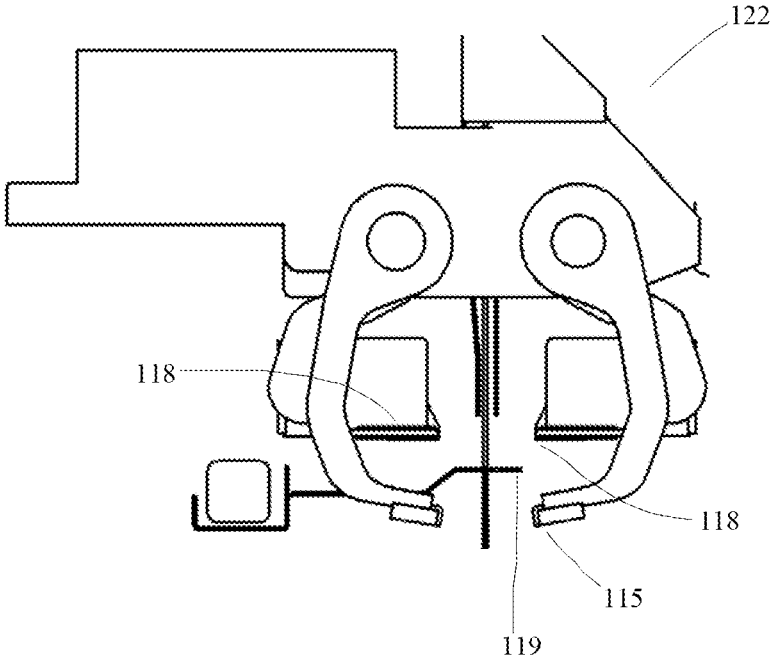
FIG. 2 the welding device of the packing machine according to FIG. 1.

The packaging machine 100 illustrated in FIG. 1 in a schematic cross-section serves for filling bags 1 with product 16. This product may for example be the bulk material 16 with particles 18 illustrated schematically above in the product feed 134. Or else it is conceivable to fill other product 16 into the bags 1 such as liquid or paste-like product.

The packaging machine 100 is configured as an FFS packaging machine and comprises a film reservoir 104 having at least one film roll. The film reservoir 104 contains rolled up tubular film or a tubular material 106 which serves for manufacturing the bags 1.

The tubular material 106 may consist of one or more plastic films. Or else it is conceivable to use other bag materials such as in particular paper or also woven tissue bags.

The providing of a supply of tubular material 106 by way of one or more tube rolls allows to manufacture bags 1 as needed. The length of the respective bags is in particular flexibly variable and can readily be adapted to any desired filled quantity. As will be explained below, it is optionally and readily possible in the case of narrow bags to widen the bag mouth width for a filling operation by way of pulling the gussets outwardly out of the bag interior for using a standard spout for filling narrow bags.

The tubular material 106 rolled off the film roll of the film reservoir 104 is conveyed via the film storage 113 into the interior of the packaging machine 100 and further to the corner welding device or the device for generating corner seams 107. The film storage 113 serves as a buffer for the indexed operation of the packaging machine 100. The film storage 113 allows even unwinding of the film roll of the film reservoir 104 while an indexed operation is provided in the interior of the packaging machine for manufacturing, filling, and subsequent closing of the bags.

Corner seams 9 are manufactured in the corner welding device 107 as needed. When a particularly small quantity of product 16 is to be filled into the bags 1, a tubular material 106 of a width 10 can be employed. To ensure attachment of the bag to the filling spout 103, the making of corner seams 9 at the filling end 12 of the bags 1 can be dispensed with in the case of bags relatively narrow in width 10 (see FIGS. 3 and 4). Then gripping fingers 120 at the spreader device 101 can widen the bag mouth at the filling end 12 by way of optionally pulling the gussets 5 outwardly from the bag interior.

As long as the inner periphery of the bag wall 2 at the filling end 12 is slightly larger or the same size as the outer periphery of the filling spout 103, filling the bags 1 by means of the packaging machine 100 is still possible. This allows to bag particularly small quantities of product 16 without involving a need of a different packaging machine 100. The invention allows the packaging of bags between for example 5 kg or less and 50 kg or more by means of the same packaging machine without involving major conversions.

Furthermore the length of each of the bags is flexibly variable as well. This allows for ease of adjustment to any desired filled quantity on the whole.

When the corner seams 9 have been made, the tubular material 106 runs through the bag length equalizer 116.

The film drive or tube drive 117 serves to transport the tubular material 106 and transports the tubular material 106 to the welding device 122. There a closing seam 7 is firstly made as a bottom seam in the first end 3 provided with folded-in gussets.

Subsequently the tubular material is conveyed further until the provided section 108 with a provided length of the bag wall 2 has been conveyed further. Subsequently the tubular material is separated by means of the cutting knife 119 at the upper, second end 4 where the bag 1 is then retained by the clamping device 115. The lower end with the previously made welding seam may optionally be cooled by means of a cooling device 123.

Figure 4:
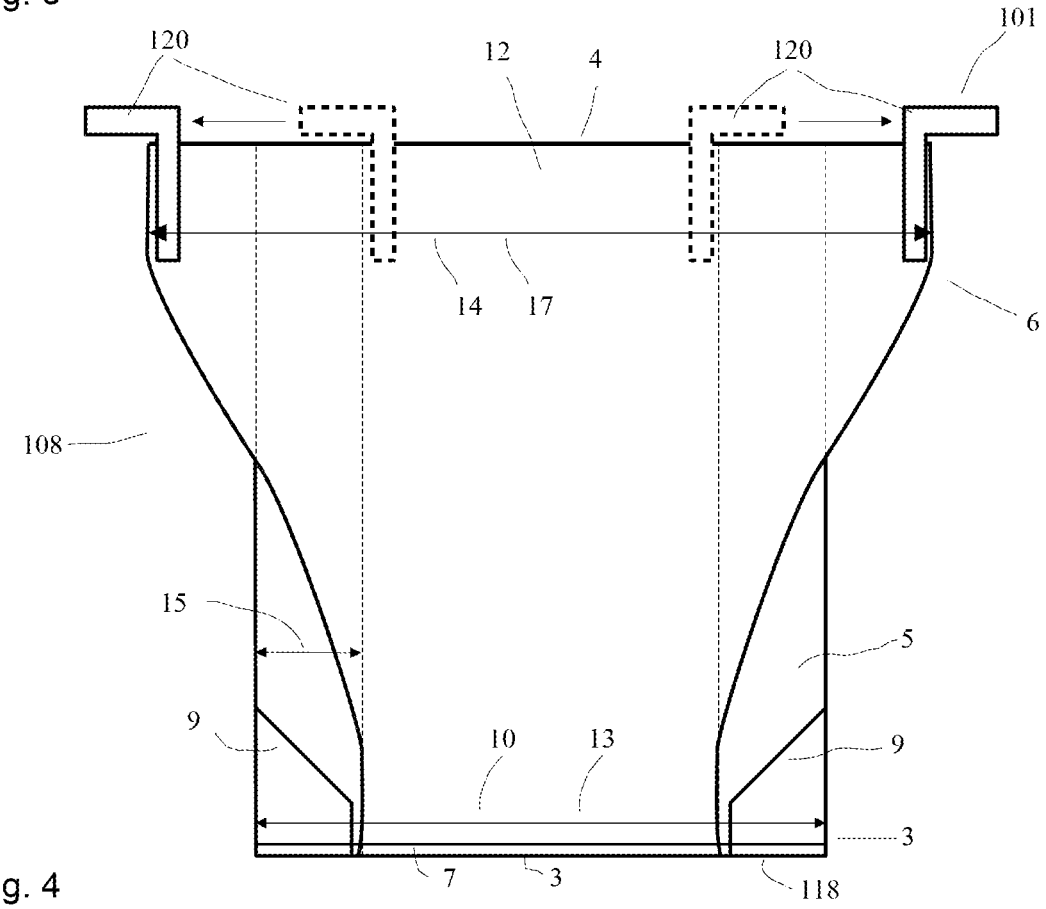
FIG. 4 a schematic side view of the bag according to FIG. 3.

Subsequently the upper end 4 of the bag is opened as needed by means of the spreader device 101 with its fingers 120 shown in phantom lines in FIG. 4, it enters the upper filling mouth which it folds open by means of the gripping fingers 120 moving outwardly, thus bringing the folded-in gussets 5 outwardly. Thus the second width 14 of the bag at the upper end 4 corresponds to the first width 13 plus double the gusset depth 15 as it is graphically illustrated in FIG. 4. The possible filling mouth 12 is considerably widened.

The bag 1 can be attached to the filling spout 103 by way of the opened gussets 5 and filled with product 16.

The conveying device 102 effects the further conveying of the bag 1. The conveying device 102 is formed as a swing conveyor and comprises swing arms 126 and a swing rod 130 at which film grippers 129 are provided.

After being conveyed further up to the closing device 135 the second, top end 4 of the bag 1 is closed with a closing seam 8 by means of welding jaws 118. Preferably the closing seams 7 and 8 are formed by weld seams 11.

At the closing device 135 a cut handle 110 may optionally be made in the upper bag wall which cut handle 110 may be surrounded by a weld seam 114 for sealing the cut handle.

Thereafter the filled bags 1 are conveyed off via the discharge belt 31 which is provided height-adjustable e.g. on a scissors table 132 and fed to a discharge line or the like.

Figure 3:
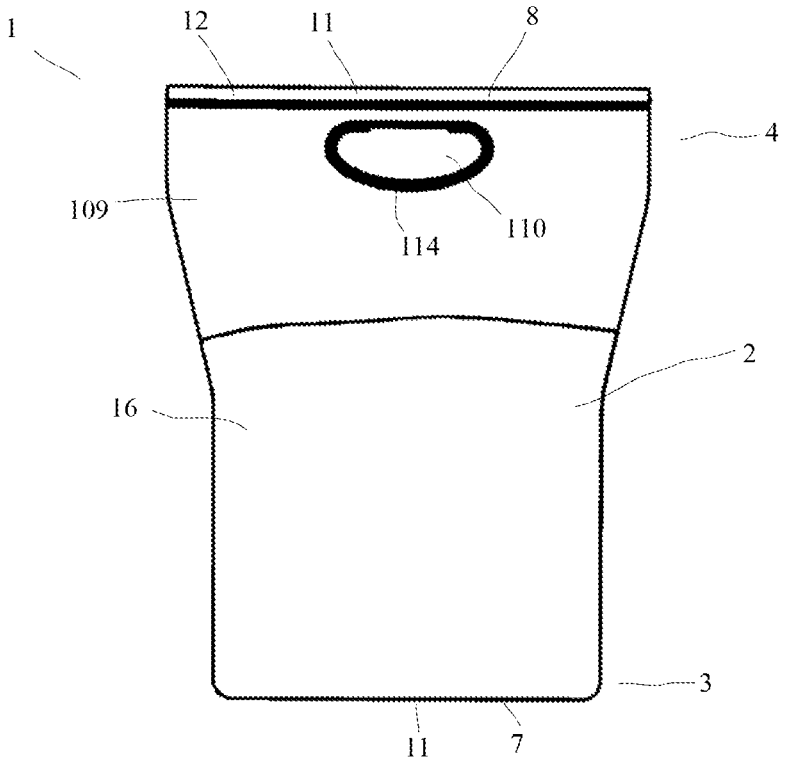
FIG. 3 a side view of a bag filled by means of the packaging machine according to FIG. 1.
Figure 5:
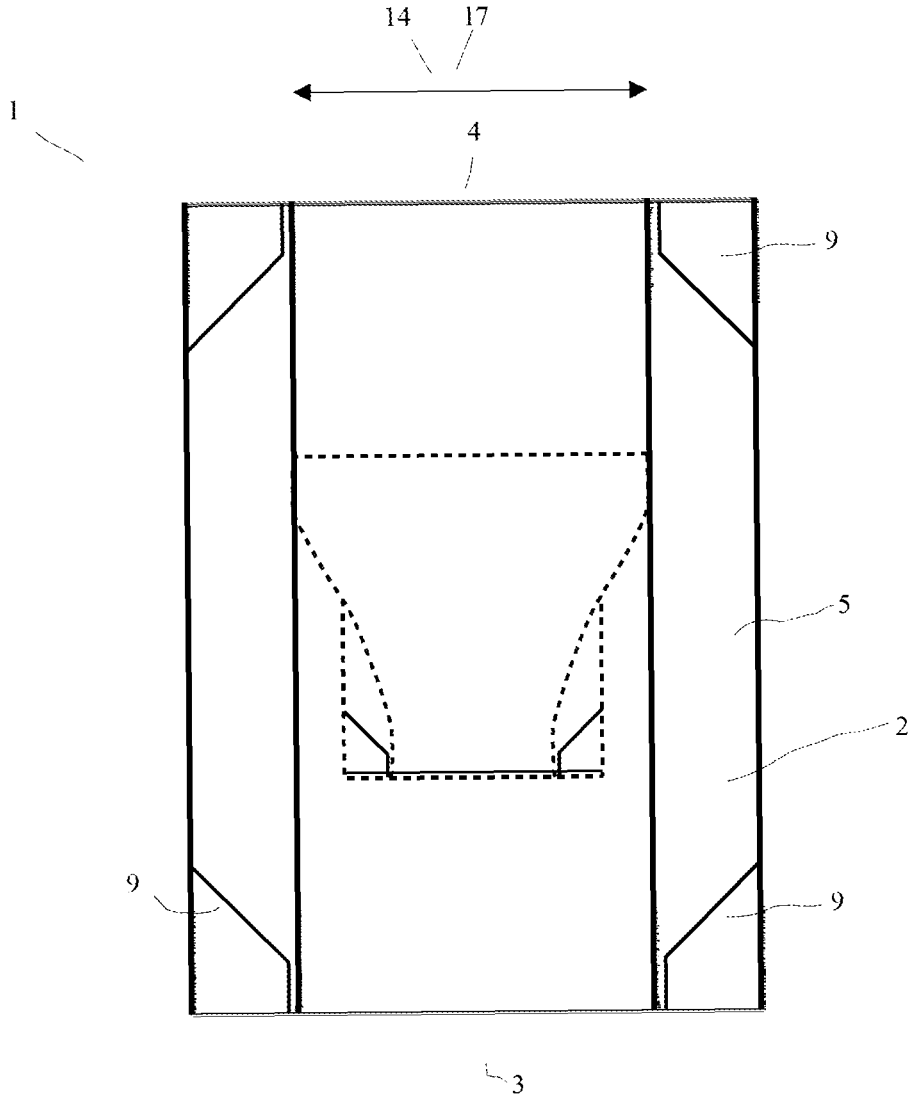
FIG. 5 a schematic side view of a bag filled by means of the packaging machine according to FIG. 1 wherein the gussets have not been pulled outwardly.

The bag may optionally be filled without pulling out the gussets 9. This applies in particular to large packages being larger in width. FIG. 5 shows such a bag 1. The circumference of the available filling mouth 17 is a maximum of double the width 14. This width can be computed from the bag width 10 from which double the depth of a gusset is subtracted. Filling by means of the existing filling spout does not pose a problem for wide bags. For narrower bag widths or tube widths the spreader device 101 with the gripping fingers 120 can be activated and the gussets are pulled outwardly so as to obtain a bag 1 as illustrated in FIG. 3. The filling operation in turn can occur using the existing filling spout. No lengthy changes are required. The range of bags to be filled not requiring any time-consuming changes can be considerably extended. This is why FIG. 5 additionally shows the narrower bag from FIG. 4 which has the same filling mouth width and can thus be filled at the same filling spout.

On the whole the invention provides a packaging machine and a method for filling a bag by means of a packaging machine wherein varying quantities of product can be bagged flexibly.

LIST OF REFERENCE NUMERALS

| | |
|---|---|
| 1 | bag |
| 2 | bag wall |
| 3 | first end |
| 4 | second end |
| 5 | gusset |
| 6 | flat bag |
| 7 | closing seam |
| 8 | closing seam |
| 9 | corner seam |
| 10 | width |
| 11 | weld seam |
| 12 | filling mouth |
| 13 | first width |
| 14 | second width |
| 15 | gusset depth |
| 16 | product |
| 17 | filling mouth |
| 18 | particle |
| 100 | packaging machine |
| 101 | spreader device/bag opener |
| 102 | conveying device/swing conveyor |
| 103 | filling spout |
| 104 | film reservoir |
| 105 | bag forming device |
| 106 | tubular material |

-continued

| | |
|---|---|
| 107 | device for creating corner seams |
| 108 | portion |
| 109 | flat bag portion |
| 110 | cut handle |
| 113 | film storage |
| 114 | weld seam |
| 115 | clamping device |
| 116 | bag length equalizer |
| 117 | film drive |
| 118 | welding jaw |
| 119 | cutting blade |
| 120 | gripping finger |
| 122 | welding device |
| 123 | cooling device |
| 126 | swing arm |
| 128 | clamping device |
| 129 | film gripper |
| 130 | swing rod |
| 131 | discharge belt |
| 132 | scissors table |
| 134 | product feed |
| 135 | closing device |

The invention claimed is:

1. Method for filling bags with bulk material wherein the bags are gusseted and extend from a first end to a second end, characterized in that optionally the gussets are pulled outwardly out of the second bag end by means of a spreader device to provide a large filling mouth and that the bag is attached to a filling spout by the opened, second end where it is filled at least in part before the second end of the bag is closed by way of at least one closing seam by means of a closing device, and wherein bags with a larger width are filled without pulling the gussets out and wherein bags with a narrower width are filled with the gussets pulled out.

2. The method according to claim 1 wherein the bag is formed at a bag forming device from a gusseted tubular material.

3. The method according to claim 1 wherein a section forming the bag wall is separated from a tubular material and a closing seam is made at the first end and the bag is filled from the second end which is subsequently closed by way of a closing seam.

4. The method according to claim 1 wherein a closing seam at the first end extends through the folded-in gussets.

5. The method according to claim 1 wherein gusset areas at the second end are pulled outwardly and the closing seam at the second end extends across folded-open gusset areas.

6. The method according to claim 1 wherein only the first end is provided with corner seams.

* * * * *